US010643551B2

(12) United States Patent
Park et al.

(10) Patent No.: US 10,643,551 B2
(45) Date of Patent: May 5, 2020

(54) METHOD OF DRIVING DISPLAY, DISPLAY DEVICE, AND SOURCE DRIVER

(71) Applicant: ANAPASS INC., Seoul (KR)

(72) Inventors: Joon Bae Park, Seoul (KR); Do Wan Kim, Seoul (KR)

(73) Assignee: Anapass Inc., Seoul (KR)

( * ) Notice: Subject to any disclaimer, the term of this patent is extended or adjusted under 35 U.S.C. 154(b) by 0 days.

(21) Appl. No.: 15/939,950

(22) Filed: Mar. 29, 2018

(65) Prior Publication Data

US 2018/0286317 A1 Oct. 4, 2018

(30) Foreign Application Priority Data

Mar. 30, 2017 (KR) ..... 10-2017-0040656
Feb. 26, 2018 (KR) ..... 10-2018-0022948

(51) Int. Cl.
*G09G 3/34* (2006.01)
*G09G 3/20* (2006.01)

(52) U.S. Cl.
CPC ..... *G09G 3/342* (2013.01); *G09G 3/2003* (2013.01); *G09G 3/2007* (2013.01); *G09G 2310/0291* (2013.01); *G09G 2310/0297* (2013.01); *G09G 2310/08* (2013.01); *G09G 2320/0673* (2013.01); *G09G 2330/021* (2013.01); *G09G 2330/022* (2013.01); *G09G 2330/028* (2013.01)

(58) Field of Classification Search
CPC ..... G09G 2330/021; G09G 2330/022; G09G 3/3685; G09G 3/3688; H04N 19/40; H04N 19/42; H04N 19/507
See application file for complete search history.

(56) References Cited

U.S. PATENT DOCUMENTS

2003/0231191 A1* 12/2003 Glen ..... G06F 3/14 345/690
2005/0012645 A1* 1/2005 Funakubo ..... H04N 19/15 341/50
2011/0228361 A1* 9/2011 Ohkawa ..... H04N 1/56 358/505
2012/0014597 A1* 1/2012 Matsunaga ..... H04N 1/644 382/166
2014/0362098 A1 12/2014 Kerofsky
(Continued)

FOREIGN PATENT DOCUMENTS

JP 2008046346 A 2/2008
JP 2009217232 A 9/2009
(Continued)

OTHER PUBLICATIONS

Office Action issued in related Japanese patent application 2018-066443, dated Mar. 12, 2019, 5 pages.
(Continued)

*Primary Examiner* — Yuzhen Shen
(74) *Attorney, Agent, or Firm* — Paratus Law Group, PLLC

(57) ABSTRACT

A method for driving a display, a display device, and a source driver. The method includes receiving and storing data obtained by dividing and compressing an image frame, decompressing the data, scanning the decompressed data, storing a result of the scanning, and displaying an image corresponding to the scan result.

10 Claims, 10 Drawing Sheets

(56) References Cited

U.S. PATENT DOCUMENTS

| | | | | |
|---|---|---|---|---|
| 2015/0042671 | A1* | 2/2015 | Chang | G06F 1/3265 345/555 |
| 2016/0358527 | A1* | 12/2016 | Bae | G09G 5/006 |
| 2018/0205967 | A1* | 7/2018 | Kim | H04N 19/176 |

FOREIGN PATENT DOCUMENTS

| | | | |
|---|---|---|---|
| KR | 1020040060708 | | 6/2004 |
| KR | 20130043703 | A | 5/2013 |
| KR | 1020140128775 | | 4/2014 |
| KR | 20150084564 | A | 7/2015 |
| TW | 201101286 | A1 | 1/2011 |

OTHER PUBLICATIONS

Office Action issued in related Korean Patent Application No. 20-2018-0086520, dated Apr. 18, 2019, 4 pages.
Office Action issued in related Taiwanese Patent Application No. 107109217, dated Feb. 27, 2019, with English Translation (21 pages).
Office Action issued in related Korean Patent Application 2011-0066731, dated Oct. 30, 2018, 89 pages.

* cited by examiner

METHOD OF DRIVING DISPLAY, DISPLAY DEVICE, AND SOURCE DRIVER

CROSS-REFERENCE TO RELATED APPLICATIONS

This application claims priority from and the benefit of Korean Patent Applications 10-2017-0040656, filed on Mar. 30, 2017 and 10-2018-0022948, filed on Feb. 26, 2018. The disclosure of each of the above-identified application is incorporated herein by reference in its entirety.

BACKGROUND

1. Field of the Invention

The present invention relates to a method for driving a display, a display device, and a source driver.

2. Related Art

In existing high-definition display devices, a compressive/non-compressive data transmission method—such as display stream compression (DSC)—is used to reduce the amount of display data transmitted from a main processor to the display device at high speed. To drive a screen with compressed data, a conversion into signals of "red", "green", and "blue" (RGB) portions of the optical spectrum is required. To this end, a decoding logic is required, and it is also necessary to use a memory for storing the compressed data. A decompressed color image signal is directly input or entered into a source driver (which is used to drive or govern the operation of display pixels), or is used as input data of the source driver via a picture quality improvement section.

Recently, in addition to a display used for a large amount of information such as video or Internet viewing, a new display usage method has appeared, that provides a small amount of information in real time through a display system. As an example, when a device is in an idle state, most of a region or area of a display panel shows or appears "black" to reduce power consumption, but information (such as time and the like) may be displayed through a part of the display panel. In this case, to reduce overall power consumption, most of the region shows or appears as a black screen, and displayed information is provided in a form of color (not black) signals or as a simple monochrome (not black) screen.

Even in this case, power consumed to generate an image with a digital circuit represents a substantially large portion of the total power consumption. Since power consumption of a logic circuit relatively increases even for a black pattern (which by itself requires low power consumption), it is necessary to efficiently improve the power consumption.

SUMMARY

The present invention is directed to reducing power consumption by limiting operations when a screen displays a simple pattern.

According to one embodiment of the present invention, a method of driving a display is provided, which includes: receiving and storing data obtained by dividing and compressing an image frame; decompressing the data; scanning the decompressed data; storing a result of the scanning; and displaying an image corresponding to and/or representing the scan result.

Another embodiment of the present invention provides a display device including: a memory configured to receive and store data obtained by dividing and compressing an image frame; a decompressor configured to read and decompress the data stored in the memory; a block scanner configured to scan the decompressed data; a pattern buffer configured to store a scan result; and a pattern generator configured to control the display device so that pattern data corresponding to the scan result is output or exhibited on the display device in a form of an image.

BRIEF DESCRIPTION OF THE DRAWINGS

The above and other objects, features and advantages of the present invention will become more apparent to those of ordinary skill in the art by describing examples of embodiments in detail with reference to the accompanying drawings, in which.

DETAILED DESCRIPTION

Figure 1:
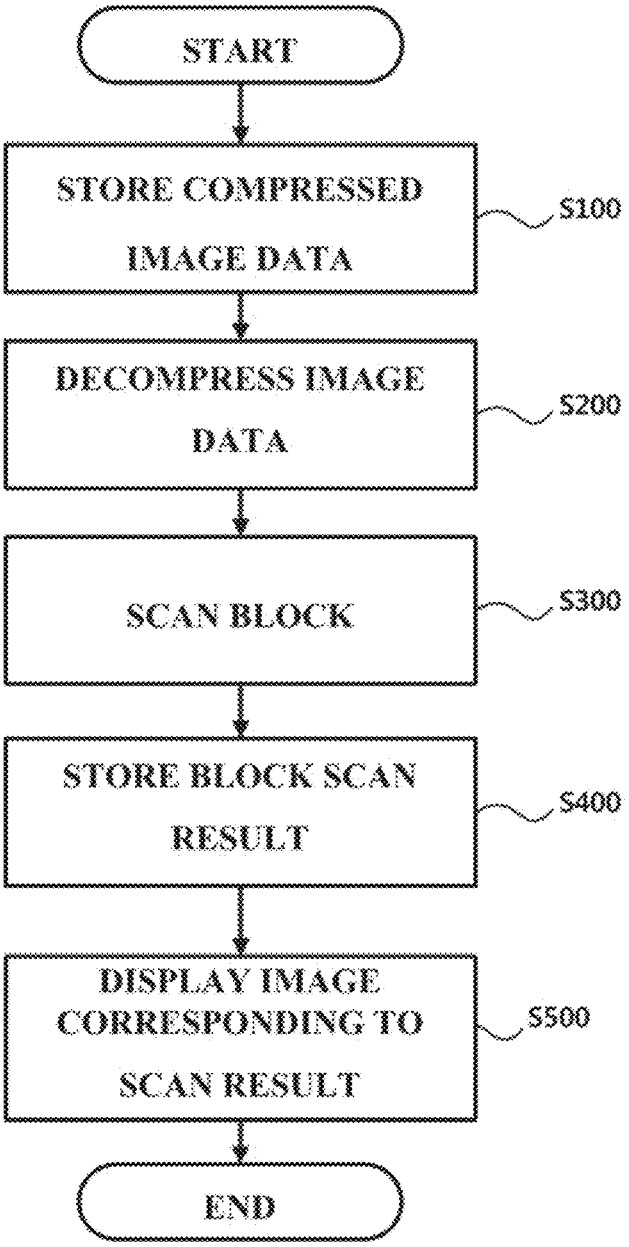
FIG. 1 is a schematic flowchart illustrating a method of driving a display device according to a first exemplary embodiment.

Specific structural and functional details disclosed herein are merely representative for purposes of describing exemplary embodiments of the present invention, and the present invention may be embodied in many alternate forms and should not be construed as limited to the exemplary embodiments of the present invention set forth herein. Accordingly, while the present invention is susceptible to various modifications and alternative forms, specific embodiments thereof are shown by way of example in the drawings and will herein be described in detail. It should be understood, however, that there is no intent to limit the present invention to the particular forms disclosed, but on the contrary, the present invention is to cover all modifications, equivalents, and alternatives falling within the spirit and scope of the present invention.

The terminology used in this specification should be understood as follows.

The terms "first," "second," etc. are only used to distinguish one element from other elements, and the scope of the present invention should not be limited by these terms. For example, a first element may be termed a second element, and vice versa.

The singular forms are intended to include the plural forms as well, unless the context clearly indicates otherwise. It will be further understood that the terms "comprise," "include," and "have," when used herein, specify the presence of stated features, integers, steps, operations, elements, parts, or combinations thereof, but do not preclude the presence or addition of one or more other features, integers, steps, operations, elements, parts, or combinations thereof.

As used herein, the term "and/or" indicates any and all combinations of one or more listed items. For example, "A and/or B" should be understood as indicating "A, B, and both A and B."

The exemplary embodiments of the present invention will be described without distinguishing a single line, a differential line, and a bus unless described otherwise. However, a single line, a differential line, and a bus will be distinguished for description as necessary.

Unless otherwise described, the present invention will be described on the basis of an active-high signaling scheme, rising edge sampling, and a switch that is turned on when a high-state signal is provided to a control electrode. Therefore, states of a signal are implemented when the signal is in a high state, and sampling is performed at a rising edge. However, these are intended for convenience of description and are not intended in any way to limit the scope of the present invention. Further, those of ordinary skill in the art may implement the present invention by using an active-low signaling scheme, falling edge sampling, and a switch that is turned on when a low-state signal is provided.

First Exemplary Embodiment

Figure 2:
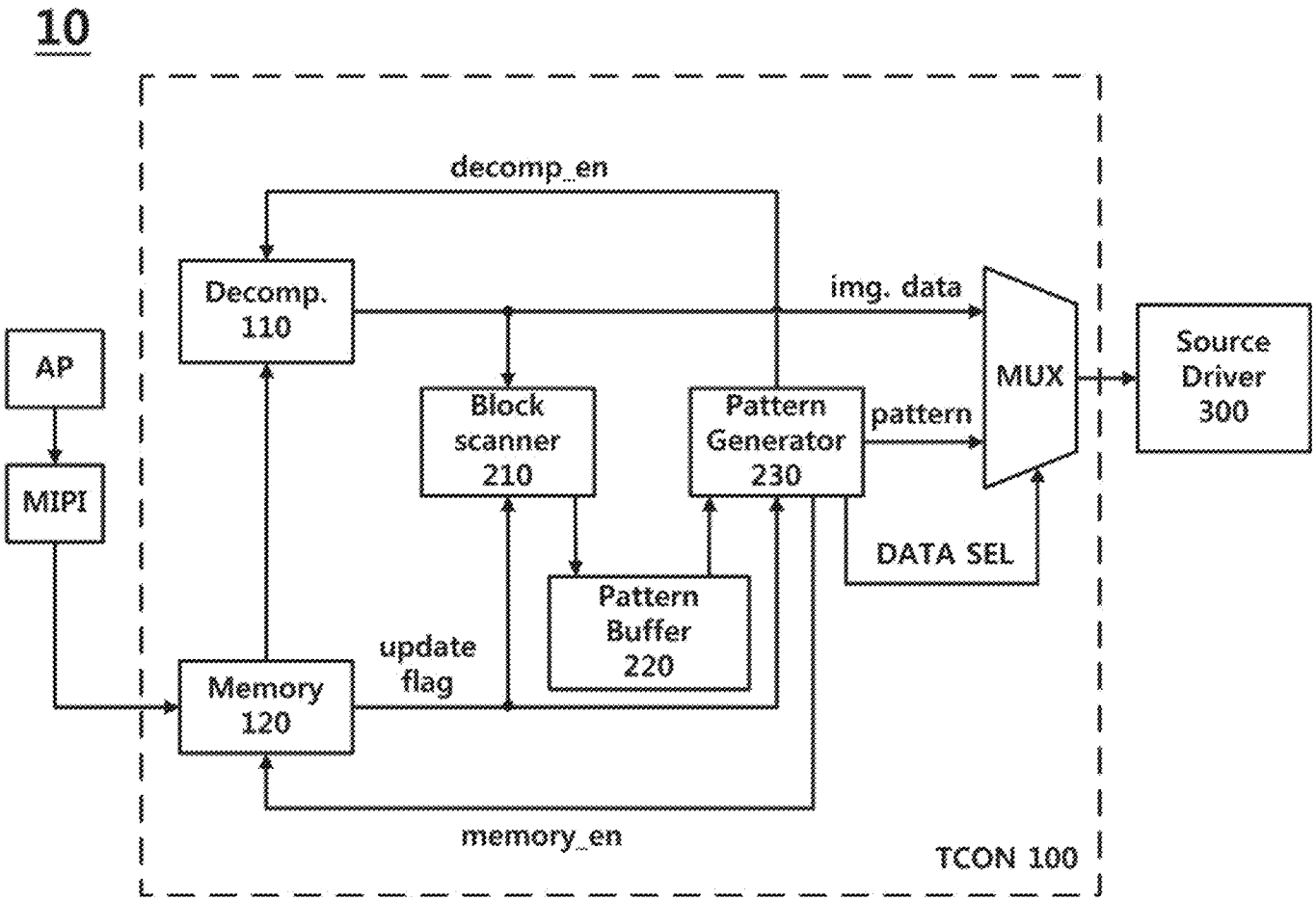
FIG. 2 is a schematic block diagram of a display device according to the first exemplary embodiment.
Figure 3:
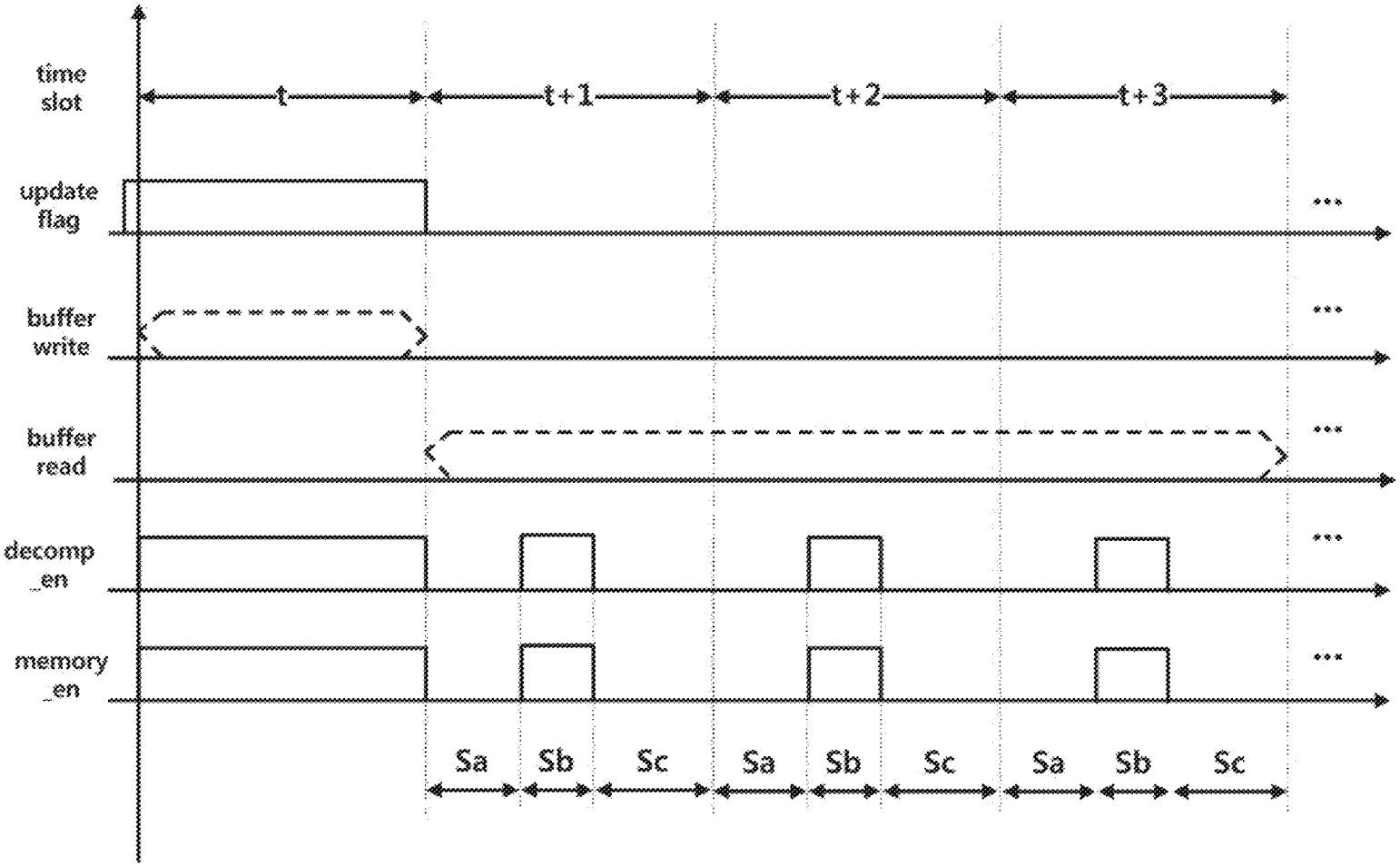
FIG. 3 is a timing diagram of the display device according to the first exemplary embodiment.

A display device and a method of driving a display device according to the present exemplary embodiment will be described below with reference to the accompanying drawings. FIG. 1 is a schematic flowchart illustrating a method of driving a display device according to the present exemplary embodiment, FIG. 2 is a schematic block diagram of a display device according to the present exemplary embodiment, and FIG. 3 is a timing diagram of the display device according to the present exemplary embodiment. Referring to FIG. 1, the method of driving a display device according to the present exemplary embodiment includes an operation of receiving and storing compressed image data (S100), an operation of decompressing the compressed image data (S200), an operation of reconfiguring the decompressed image to generate blocks and scanning a predetermined pattern (S300), an operation of storing a scan result in a pattern buffer (S400), and an operation of displaying an image corresponding to the scan result (S500).

A display device 10 according to the present exemplary embodiment includes a memory 120 that receives and stores data obtained by dividing and compressing an image frame, a decompressor 110 that reads and decompresses the data stored in the memory 120, a block scanner 210 that scans the decompressed data, a pattern buffer 220 that stores a scan result, and a pattern generator 230 that controls a display so that pattern data corresponding to the scan result is output on the display.

Figure 4:
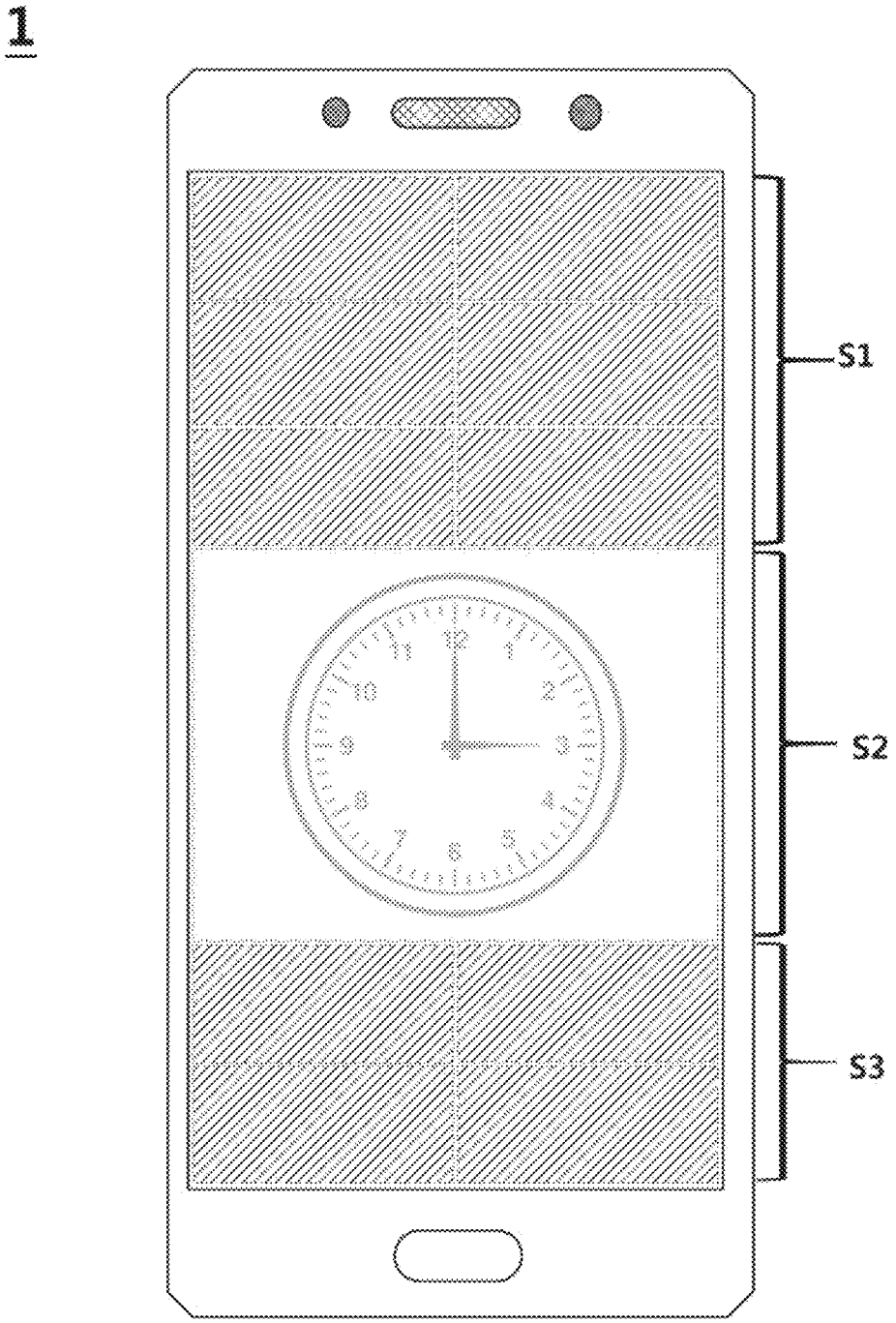
FIG. 4 is a schematic diagram showing a display device in an idle state.

FIG. 4 is a schematic diagram showing a display device 1 in an idle state. Referring to FIG. 4, an application processor AP may divide one frame image into a plurality of regions and transmit image data through an interface (e.g., mobile industry processor interface (MIPI)) according to the divided regions. In an exemplary embodiment, the application processor AP may divide and transmit the frame image according to a digital stream compression (DSC) protocol. In an exemplary embodiment, when the display device 1 is in an idle state, the application processor AP may display a simple pattern that appears as some regions S1 and S3 filled with a single color in and display a non-simple pattern in another region S2. The simple pattern of a region in this case is recognized when such region displays a single color or is colored monochromatically. (As discussed below, another type of a simple pattern is defined by a pattern having a pre-determined, a priori assigned shape such as a grid pattern or a diamond pattern, for example.) A given region is characterized by a non-simple pattern if such region displays or exhibits any other pattern except a pattern defined as a simple pattern.

Referring to FIGS. 1 to 3, the application processor AP provides image data, which corresponds to an image desired to be displayed through a display panel and a region desired to be displayed, through the interface to the memory 120 in a timing controller (TCON) 100. In an exemplary embodiment, the application processor AP divides an image frame into regions corresponding to an image compression protocol of DSC, compresses image data corresponding to the divided regions, and provides the compressed image data to the memory 120. In another exemplary embodiment, the application processor AP may compress only image data corresponding to a region in which an image will be updated and may provide the compressed image data to the memory 120.

In an exemplary embodiment, the interface through which the application processor AP transmits compressed data may be an MIPI that is an interface between components of a mobile device.

The memory 120 receives the compressed image data from the application processor AP through the interface MIPI and stores the compressed image data.

In an exemplary embodiment, the image data provided by the application processor AP may be image data obtained by dividing any one frame into regions and compressing the divided regions. In another exemplary embodiment, the image data provided by the application processor AP may be image data of a region desired to be updated in any one frame.

The decompressor 110 reads the compressed image data from the memory 120, decompresses the compressed image data, and outputs image data img.data according to the divided regions (S200). The decompressor 110 decompresses the compressed image data according to a protocol with which the application processor AP has compressed the image data. As an example, when the application processor AP compresses image data according to the DSC protocol, the decompressor 110 decompresses the compressed image data according to the same protocol as the DSC protocol.

In an exemplary embodiment, when new image data is received from the application processor AP, the timing controller 100 keeps an update flag updateflag in a high state. When the update flag updateflag is in a high state, the pattern generator 230 activates the memory 120 and the decompressor 110 by providing a memory activation signal memory_en and a decompressor activation signal decomp_en so that the new image data is stored and/or decompressed. When the update flag updateflag is in a low state, whether the memory 120 and the decompressor 110 are activated may be determined according to a pattern of the image data img.data. In an exemplary embodiment shown in FIG. 2, the update flag updataflag may be provided by the memory 120.

The image data img.data output by the decompressor 110 is provided to the block scanner 210. The block scanner 210 generates a block by reconfiguring the provided image data img.data, determines whether the block is composed of a simple pattern by scanning the block, and stores the scan result in the buffer 220 (S300 and S400). As an example, the block scanner 210 is configured to determine, in operation, whether the reconfigured block corresponds to a simple pattern by scanning the block (and optionally produce indicia representing results of such determination). The simple pattern may be a pattern of a single, monochromatic color such as black, grey, white, or the like. As another example, the simple pattern may be a pattern of a predetermined shape such as a grid pattern, a diamond pattern, or the like. When it is determined that the block reconfigured in the scanning process corresponds to a simple pattern, the block scanner 210 stores, in the buffer 220, a scan result indicating which one of a predetermined plurality of simple patterns corresponds to the simple pattern. Therefore, the scan result provided by the block scanner 210 may include a determination result whether the reconfigured block corresponds to a simple pattern and classification result which one of the predetermined plurality of simple patterns corresponds to the reconfigured block.

In an exemplary embodiment, the block scanner 210 may determine whether the block is composed of a simple pattern by comparing at least one among pixel coordinates of the block, pixel values of the block, and an average of the pixel values with a predetermine threshold value.

In an exemplary embodiment, the block reconfigured by the block scanner 210 may be the same as a block generated by the application processor AP dividing the frame image. In another exemplary embodiment, the block generated by the block scanner 210 may be larger than a block generated by the application processor AP dividing the frame image. In another exemplary embodiment, the block generated by the block scanner 210 may be smaller than a block generated by the application processor AP dividing the frame image.

The pattern generator 230 receives the update flag updateflag and controls a multiplexer MUX by providing a data selection signal DATA SEL so that the multiplexer MUX outputs image data which is output by the decompressor 110 or image data corresponding to a simple pattern.

In an exemplary embodiment, when a scan result of the block read from the buffer 220 corresponds to any one of predetermined simple patterns, the pattern generator 230 may generate and output image data corresponding to the scan result (S500). In another exemplary embodiment, the pattern generator 230 may include therein a memory (not shown) configured to store image data corresponding to (or representing) a predetermined plurality of simple patterns (or, for short, memory configured to store patterns). As described above, the predetermined plurality of simple patterns may be a pattern of a single color such as black, grey, white, or the like, or a geometric pattern such as a grid pattern, a diamond pattern, or the like.

The pattern generator 230 may read a scan result of the block from the buffer 220 and output simple pattern image data, which corresponds to the scan result and is stored in the pattern generator 230, when the scan result corresponds to (or represents) a simple pattern stored in the pattern generator 230.

When the scan result of the block read from the buffer 220 corresponds to (or represents) a simple pattern, the pattern generator 230 controls the multiplexer MUX with the data selection signal DATA SEL so that image data corresponding to the simple pattern is provided to a source driver 300 (S700). When the scan result read from the buffer 220 does not correspond to a simple pattern, the pattern generator 230 activates the memory 120 and the decompressor 110 with the memory activation signal memory_en and the decompressor activation signal decomp_en.

The activated decompressor 110 decompresses the compressed data stored in the memory 120, and the pattern generator 230 controls the multiplexer MUX by providing the data selection signal DATA SEL so that image data of the block is provided to the source driver 300. The source driver 300 drives the display panel so that the display panel displays an image corresponding to the provided image data.

The method of driving a display according to the present exemplary embodiment will be schematically described below with reference to FIGS. 1 to 4. It is assumed that image data, which is provided by an application processor in a time slot t, corresponds to an image shown in FIG. 4, simple patterns are displayed in the regions S1 and S3, and a non-simple pattern is displayed in the region S2.

When the application processor AP provides image data obtained by dividing and compressing an image frame in the time slot t, the timing controller 100 switches the update flag updateflag to a high state. The decompressor 110 decompresses the image data which is provided according to the high-state update flag according to a corresponding protocol and outputs the decompressed image data.

The block scanner 210 receives image data of blocks included in the regions S1, S2, and S3, separately scans the blocks included in the respective regions S1, S2, and S3, and stores the scan results in the buffer 220 (buffer write). For example, since blocks included in the region S1 are simple patterns filled with black, the block scanner 210 scans the block image data and stores, in the pattern buffer 220, a scan result indicating that the blocks are simple patterns and single-color patterns filled with black color. Since an image displayed by blocks included in the region S2 is not a simple pattern, the block scanner 210 stores, in the pattern buffer 220, a scan result indicating that the blocks included in the region S2 are non-simple patterns. The block scanner 210 receives block image data corresponding to the region S3, which is a simple pattern filled with black, scans the block image data, and stores, in the pattern buffer 220, a scan result indicating that corresponding blocks are black simple patterns. In a time slot t+1, image update is not performed, and thus the update flag updateflag is switched to a low state. In a period Sa of the time slot t+1, the pattern generator 230 reads the scan result of the region S1 stored in the pattern buffer 220, and determines what kind of simple patterns corresponding blocks are when the corresponding blocks are simple patterns (buffer read). Since all the blocks included in the region S1 are black, the scan result of the blocks is stored in the buffer 220 as simple patterns of a single color which is black.

The pattern generator 230 compares a plurality of simple patterns stored therein with a scan result stored in the pattern buffer 220. When a simple pattern stored in the pattern generator 230 corresponds to the scan result stored in the pattern buffer 220, the pattern generator 230 outputs image data corresponding to the scan result and provides the image data to the source driver 300 by controlling the multiplexer MUX.

As an example, the pattern generator 230 may generate and output image data corresponding to a simple pattern. As another example, the pattern generator 230 may output image data stored in the internal memory (not shown).

The scan result of the blocks included in the region S2 is stored in the pattern buffer 220 as non-simple patterns. In a period Sb, the pattern generator 230 reads the scan result indicating non-simple patterns and activates the memory 120 and the decompressor 110 by providing the memory activation signal memory_en and the decompressor activation signal decomp_en. The pattern generator 230 provides image data, which is provided by the decompressor 110 and corresponds to the blocks included in the region S2, to the source driver 300 by controlling the multiplexer MUX with the data selection signal DATA SEL.

Since all the blocks included in the region S3 are also single-color patterns filled with black, the scan result of the blocks is stored in the buffer 220 as simple patterns of a single color which is black and coincides with a result stored in the pattern generator 230. In a period Sc, the pattern generator 230 provides image data corresponding to the simple patterns to the source driver 300 through the multiplexer MUX.

Since the application processor AP drives the decompressor 110 and the memory 120 for a partial pattern update by providing image data of a block to be updated, it is possible to additionally reduce power consumption.

According to the related art, even when no image update of a new frame is performed by an application processor, or even while user information, such as time, is displayed in a partial display region, a display device decompresses a compressed image stored in a previous frame and provides an input signal for display driving to a source driver. For this reason, since a decompressor and a memory are driven in one frame, there is unnecessary power consumption.

However, according to the present embodiment, when the image data stored in the pattern buffer 220 corresponds to the predetermined pattern and there is no image update, the memory 120 and the decompressor 110 are deactivated, and thus it is possible to reduce power consumption.

Second Exemplary Embodiment

A second exemplary embodiment will be described below with reference to the accompanying drawings. However, descriptions that are identical or similar to those of the first exemplary embodiment may be omitted for simplicity and clarity. Since the first and second exemplary embodiments are not mutually exclusive, at least some of the components described in the first exemplary embodiment and at least some of components described in the second exemplary embodiment may be implemented together.

Figure 5:
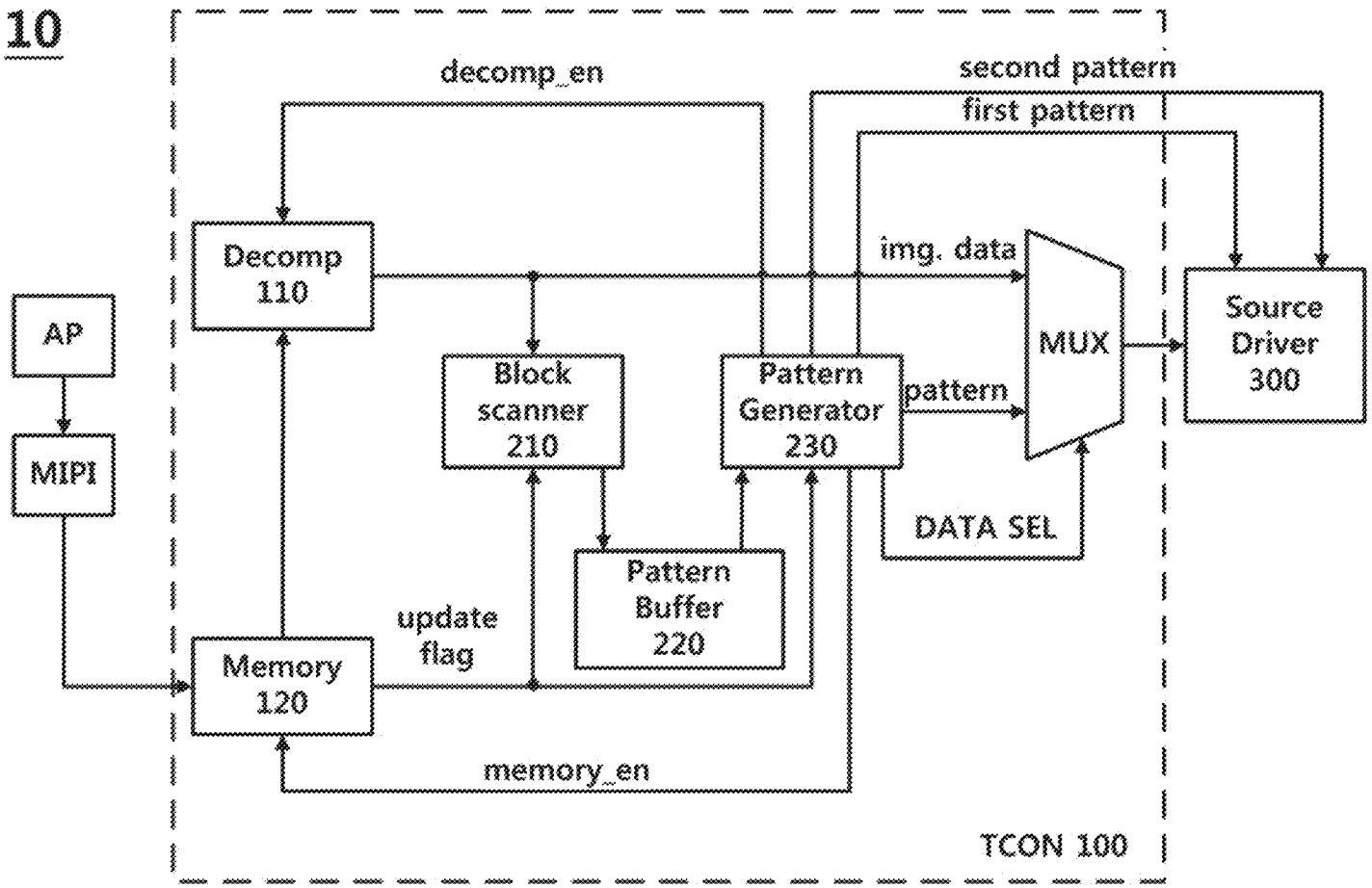
FIG. 5 is a schematic diagram of a display device according to a second exemplary embodiment.
Figure 6:
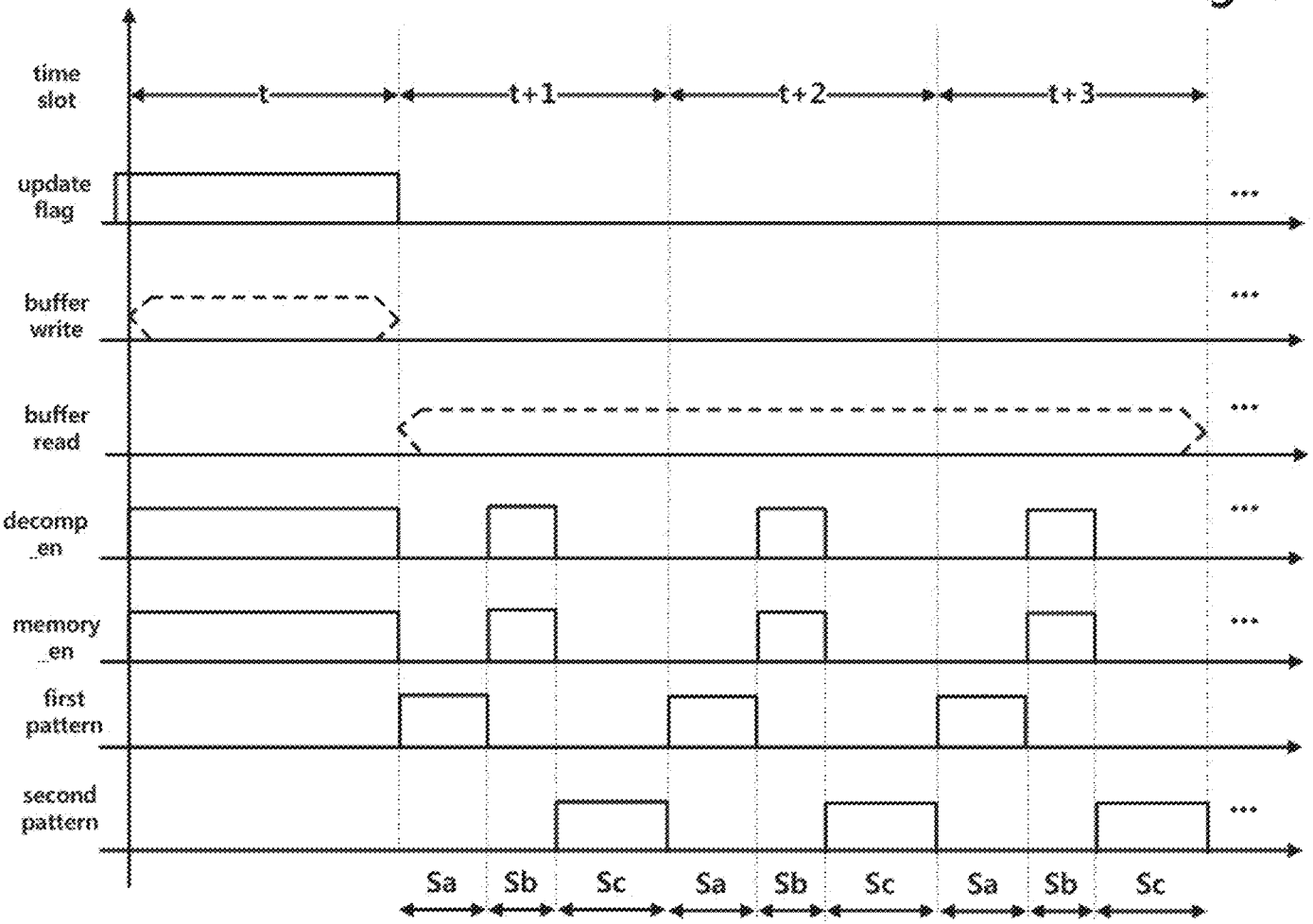
FIG. 6 is a timing diagram of the display device according to the second exemplary embodiment.
Figure 7:
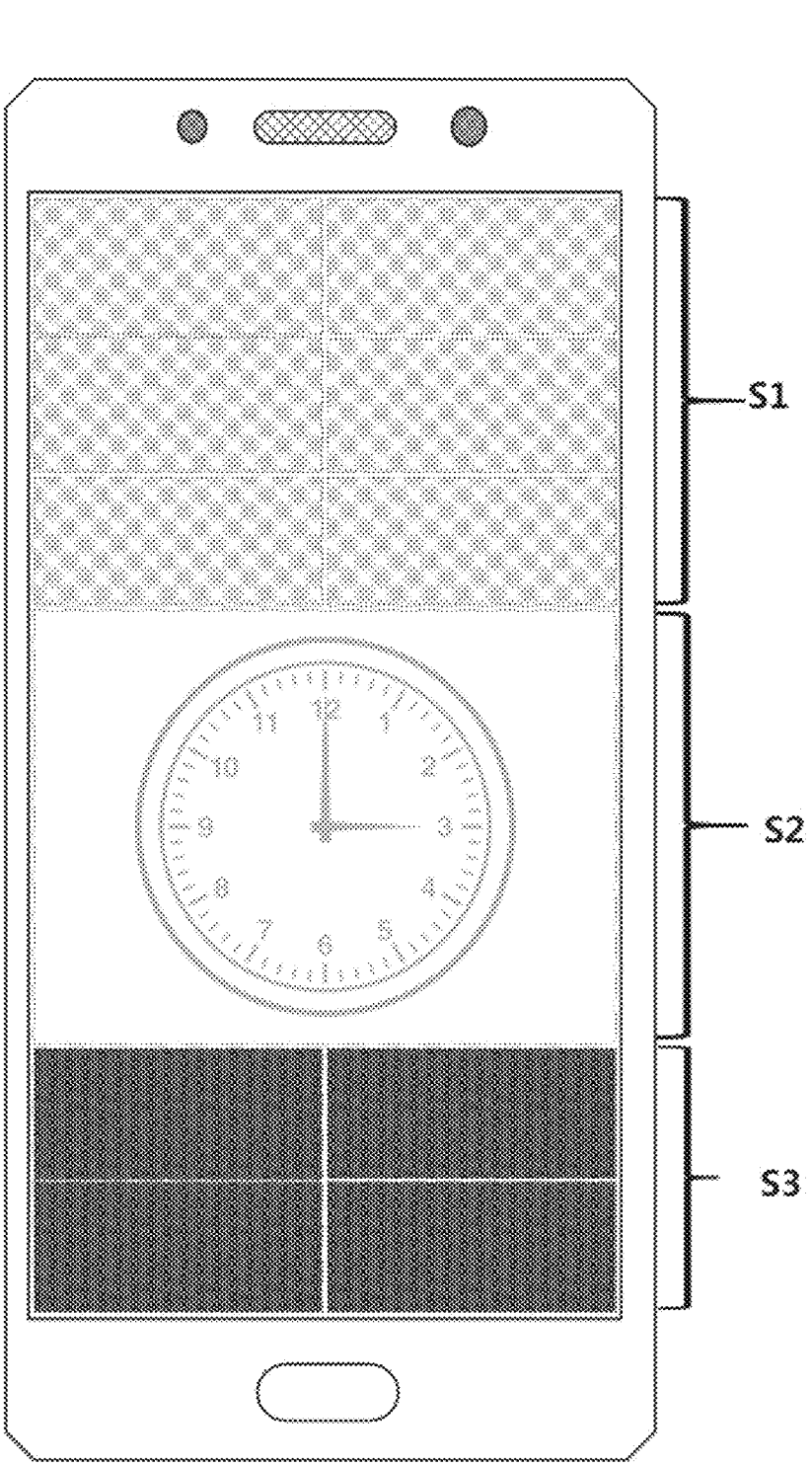
FIG. 7 is a schematic diagram showing a display device in an idle state.

FIG. 5 is a schematic diagram of a display device according to the second exemplary embodiment, and FIG. 6 is a timing diagram of the display device according to the second exemplary embodiment. It is assumed that image data, which is provided from an application processor in a time slot t, corresponds to an image shown in FIG. 7, first and second simple patterns are respectively displayed in regions S1 and S3, and a non-simple pattern is displayed in a region S2. Referring to FIGS. 5 to 7, a block scanner 210 reconfigures image data img.data provided by a decompressor 110 into predetermined blocks. The block scanner 210 determines whether each of the reconfigured blocks corresponds to any one of predetermined simple patterns by scanning and classifying the respective blocks. In an example, a predetermined simple pattern may be a pattern that fills a block with black. In another example, a predetermined simple pattern may be a single-color pattern that fills a block with a single color such as grey, green, or the like. In another example, a predetermined simple pattern may be a pattern that fills a block with a geometric figure such as a grid figure, a diamond figure, checkerboard figure, or the like. A scan result which results in the determination is provided to a buffer 220 (buffer write).

As the update flag updateflag is switched to a low state, the pattern generator 230 reads scan results of blocks from the pattern buffer 220 (buffer read). When a scan result of blocks corresponds to a first pattern stored in the pattern generator 230, a first pattern signal (first pattern) is provided to the source driver 300, and when a scan result of blocks corresponds to a second pattern, a second pattern signal (second pattern) is provided to the source driver 300. For example, the first pattern may be a pattern that fills a block with black, and the second pattern may be a pattern that fills a block with a single color such as grey, green, or the like.

Since a scan result, which is read from the buffer 220 by the pattern generator 230 in a time slot t+1, corresponds to the first pattern, the pattern generator 230 switches the first pattern signal (first pattern) to a high state. The first pattern signal in a high state is provided to the source driver 300 (in a period Sa).

The pattern generator 230 reads a result classified as a non-simple pattern from the pattern buffer 220 and activates the memory 120 and the decompressor 110 by providing a memory activation signal memory_en and a decompressor activation signal decomp_en so that a non-simple pattern is displayed (in a period Sb).

Since a scan result of the region S3, which is read from the buffer 220 by the pattern generator 230, corresponds to the second pattern, the pattern generator 230 switches the second pattern signal (second pattern) to a high state. The second pattern signal in a high state is provided to the source driver 300 (in a period Sc).

When the first pattern signal (first pattern) or the second pattern signal (second pattern) is received, the source driver 300 drives the display device so that a pattern corresponding to the received pattern signal is displayed.

The appended drawings have been described on the assumption that there are only two patterns, that is, the first pattern and the second pattern. However, the assumption is only intended for description, and the number of predetermined simple patterns and the number of signals indicating the respective simple patterns may be increased or reduced.

According to the present exemplary embodiment, when a scan result of a block corresponds to a predetermined pattern, the pattern generator 230 provides a signal corresponding to the pattern to a source driver without generating the pattern. Therefore, it is possible to reduce power consumed for generating the pattern.

Source Driver

Figure 8:
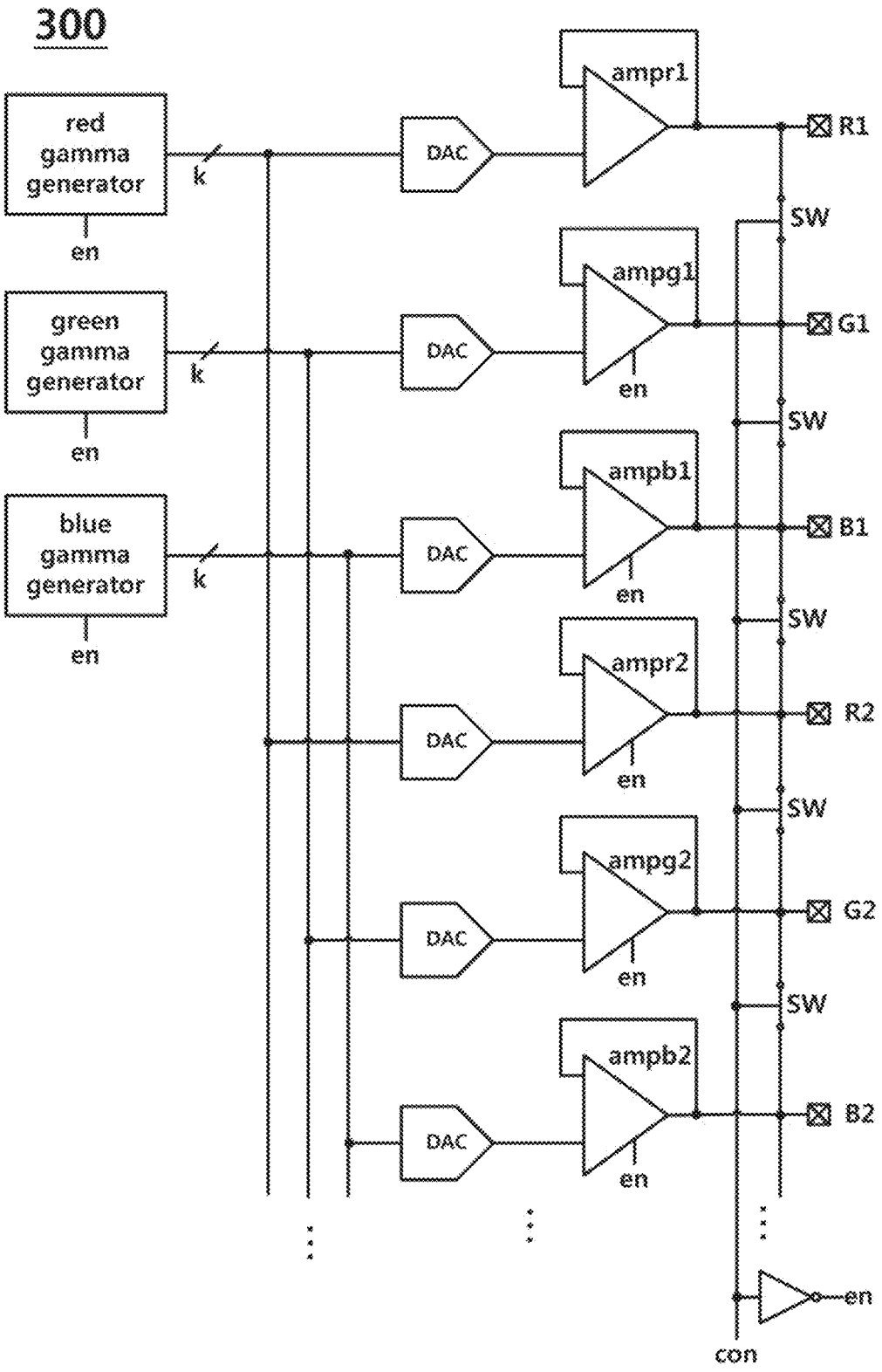
FIGS. 8, 9, and 10 are diagrams exemplifying source driver that receives a first pattern signal and a second pattern signal and displays corresponding patterns.
Figure 9:
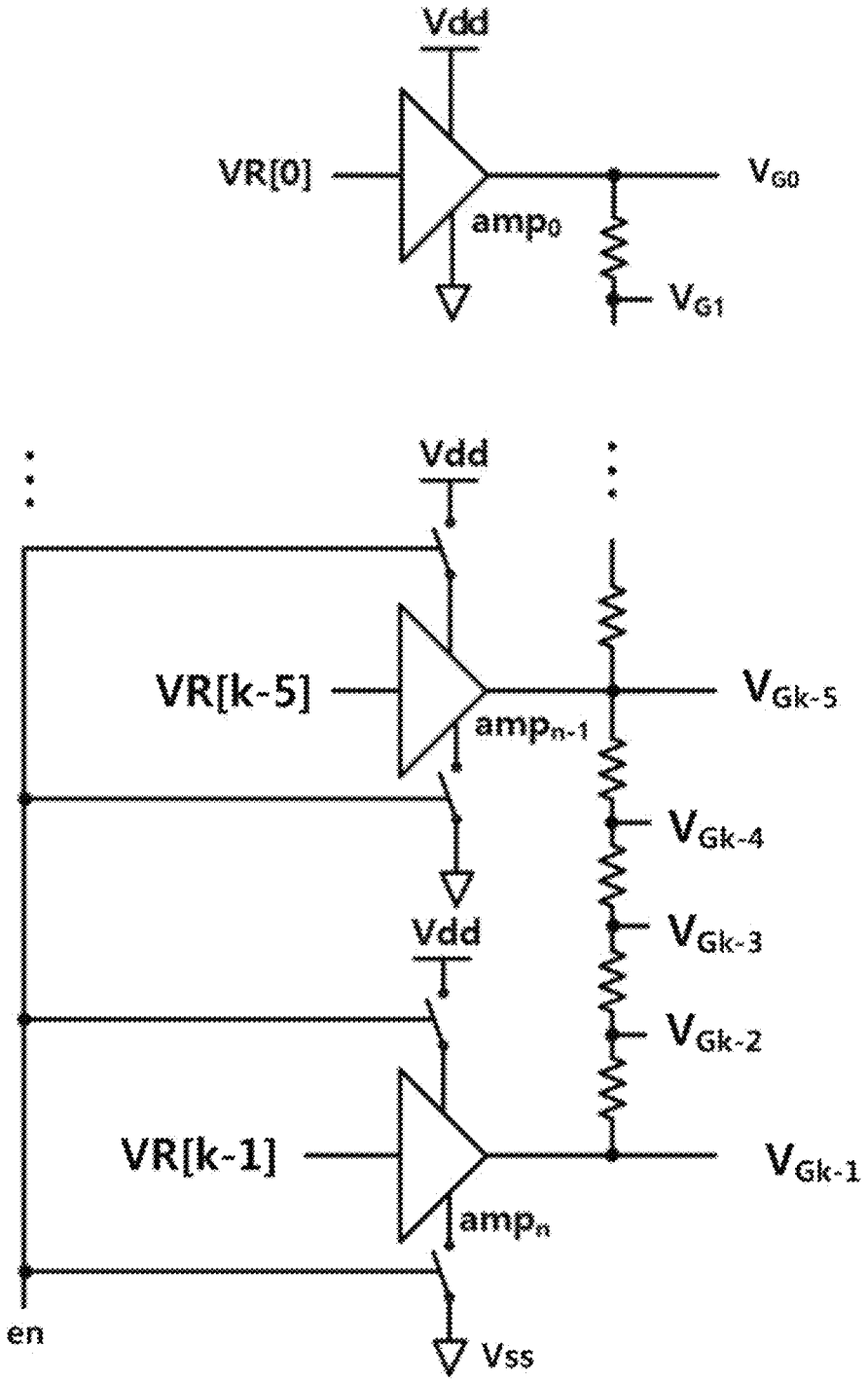

A source driver 300 will be schematically described below. FIG. 8 is a diagram of a source driver according to an exemplary embodiment, and FIG. 9 is a schematic circuit diagram of a red gamma generator. Referring to FIGS. 8 and 9, the source driver 300 includes the red gamma generator, a green gamma generator, a blue gamma generator, digital-to-analog converters DAC that convert gamma signals provided by the gamma generators into corresponding grayscale signals, buffer amplifiers ampr1, ampg1, ampb1, ampr2, ampg2, ampb2, . . . that amplify the grayscale signals and provide the amplified grayscale signals to pixels, which are loads, and switches SW that electrically connect the pixels.

The switches SW may be controlled by a control signal con, which may be any one of the first pattern signal (first pattern) and the second pattern signal (second pattern) of FIGS. 5 and 6 or a signal generated by logical calculation from the first and second pattern signals (first pattern and second pattern). In the exemplary embodiment shown in FIG. 8, when the switches SW are turned on, the same grayscale voltage may be provided to pixels R1, G1, B1, R2, G2, B2, . . . included in a group.

When the control signal con in a logic high state is provided, the green gamma generator and the blue gamma generator are deactivated by an activation signal en which is generated by inverting the control signal con. Also, a plurality of amplifiers $amp_n$, $amp_{n-1}$, . . . , $amp_1$ included in the red gamma generator are deactivated by the activation signal en provided to the red gamma generator, but an amplifier $amp_0$ that outputs a predetermined gamma voltage is driven and outputs a target grayscale voltage. As shown in FIG. 9, when the activation signal en in a logic low state is provided, switches are turned off, and a driving voltage Vdd, Vss is not provided to the amplifiers . . . , $amp_{n-1}$, and $amp_n$ that provide gamma voltages.

In an exemplary embodiment, the predetermined gamma voltage may be a voltage corresponding to black, and the amplifier $amp_0$ that outputs the predetermined gamma voltage may be formed as a large-size transistor and may have a high current-driving capability. The exemplary embodiment shown in FIGS. 8 and 9 is a mere example, and amplifiers included in the blue or green gamma generator rather than the red gamma generator may be driven and may output a gamma voltage.

The gamma voltage output by the amplifier $amp_0$ is provided to digital-to-analog converters DAC, converted into a grayscale signal corresponding to the gamma voltage, and provided to buffer amplifiers. The buffer amplifiers ampg1, ampb1, ampr2, ampg2, ampb2, . . . are provided with the activation signal en in the logic low state and thus deactivated, and the predetermined amplifier ampr1 buffers and outputs the grayscale signal output by a digital-to-analog converter DAC. The amplifier ampr1 that drives a plurality of electrically connected pixels may include large-size transistors for an improved current-driving capability and may accordingly have a larger size than other amplifiers.

The control signal con in the logic high state is provided to control electrodes of the switches SW, and the switches SW are turned on. Therefore, the same (identical) grayscale voltage is provided to the plurality of pixels R1, G1, B1, R2, G2, B2, . . . .

According to the above exemplary embodiment, when a plurality of pixels are all required to display the same color, for example, black, only one of a plurality of amplifiers included in gamma generators may be driven to output a gamma voltage, and only one amplifier may be driven to drive pixels included in a group. Therefore, it is possible to reduce unnecessary power consumption.

Figure 10:
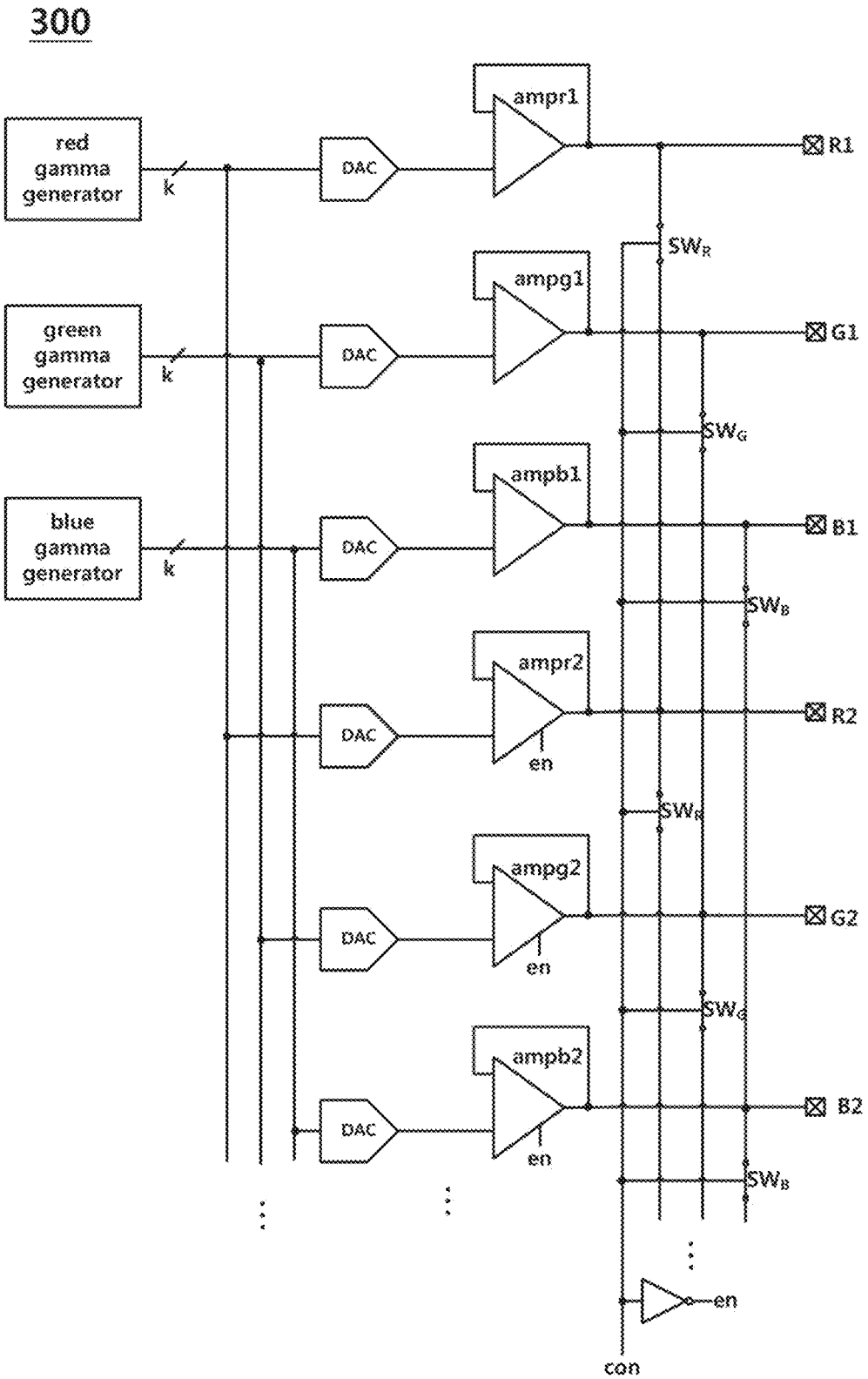

FIG. 10 is a diagram of a source driver 300 according to another embodiment. Referring to FIG. 10, switches electrically connect pixels of the same group together. In an embodiment, a switch SWR may be turned on and may electrically connect pixels R1, R2, . . . which display red together in the group, a switch SWG may be turned on and may electrically connect pixels G1, G2, . . . which display green together in the group, and a switch SWB may be turned on and may electrically connect pixels B1, B2, . . . which display blue together in the group.

In the embodiment shown in FIG. 10, gamma generators may receive image data corresponding to a simple pattern provided by a timing controller and provide corresponding gamma voltages. In another example, the gamma generators may receive an activation signal en, and like illustrated in FIG. 9, amplifiers may be deactivated excluding an amplifier which outputs a predetermined gamma voltage.

Gamma signals output separately by red, green, and blue gamma generators are provided to digital-to-analog converters DAC, converted into grayscale voltages, which are corresponding analog signals, and provided to amplifiers. Since the activation signal en in a logic low state is received, amplifiers ampr2, ampg2, ampb2, . . . are deactivated, but predetermined amplifiers ampr1, ampg1, and ampb1 buffer and output grayscale signals converted by digital-to-analog converters DAC. The amplifier ampr1 that drives a plurality of electrically connected pixels may include large-size transistors for an improved current-driving capability and may accordingly have a larger size than other amplifiers. There may be one predetermined amplifier per color displayed by pixels.

A control signal con in a logic high state is provided to control electrodes of the switches SW, and the switches SW are turned on. Therefore, the same grayscale voltage is provided to pixels for displaying the same color, and the pixels for displaying the same color display the same color.

The above-described embodiments of a source driver may be implemented separately or in combination.

According to the present example of embodiment, when there is no change in an image displayed in a display panel, it is possible to reduce power provided to amplifiers and a gamma voltage provider, which drive the display panel, according to a pattern analysis result. Therefore, it is possible to reduce unnecessary power consumption.

According to examples of embodiments of the present invention, when an image displayed in a certain region of a display device corresponds to a specific pattern, it is possible to reduce power consumption.

Notably, any of gamma generators, converters, buffer amplifiers, switches, pattern generators, block scanners, decompressors, pattern buffers, and other components of sub-systems of the described device and/or system include or are represented by a corresponding electronic circuitry designed, structured, and/or configured to operate as discussed.

Although examples of embodiments of the present invention have been described in detail above with reference to the accompanying drawings, those of ordinary skill in the art will appreciate that various modifications and equivalents may be made from the exemplary embodiments. Therefore, the technical scope of the present invention should be determined by the following claims.

What is claimed is:

1. A display device comprising:

a memory configured to receive and store first data, obtained by dividing and compressing an image frame, to create stored data;

a decompressor configured to read and decompress the data stored data in the memory to form decompressed data;

a block scanner configured to scan the decompressed data to produce block scanner output data;

a pattern buffer configured to store the block scanner output data; and a pattern generator configured to control a display to display an image, representing data of a pattern that corresponds to the block scanner output data, on the display, wherein the memory is configured to provide an update flag signal in a first state if the memory receives the first data, the pattern generator is configured to output a decompressor enable signal and a memory enable signal in response to the update flag signal in the first state, and the decompressor is activated by the decompressor enable signal, and wherein the memory is configured to provide the update flag signal in a second state different from the first state if there is no image update, and the decompressor is deactivated while the update flag signal is in the second state.

2. The display device of claim 1, wherein the block scanner, in operation, produces indicia of a determination of whether the first data correspond to a simple pattern.

3. The display device of claim 2, wherein, when the first data correspond to the simple pattern, the block scanner is configured to scan the first data to classify which one of a plurality of pre-stored simple patterns corresponds to the first data.

4. The display device of claim 2, wherein the simple pattern shows black in a portion of a divided image frame.

5. The display device of claim 2, wherein the simple pattern is any one of a pattern showing a predetermined figure and a pattern showing the same single color in a portion of a divided image frame.

6. The display device of claim 2, further comprising a multiplexer, and wherein the pattern generator is further configured to control the multiplexer to produce an output including the decompressed data when the indicia represent that the block scanner output data correspond to a non-simple pattern.

7. The display device of claim 1, wherein the pattern generator includes a pattern memory configured to store patterns, and is further configured to produce an output representing a particular pattern, from the plurality of patterns stored in the memory, when the block scanner output data correspond to the particular pattern from the plurality of patterns stored in the memory.

8. The display device of claim 1, wherein the pattern generator is configured to generate and output the pattern that corresponds to the block scanner output data.

9. The display device of claim 1, further comprising a source driver, wherein the pattern generator is configured to provide a control signal to the source driver to display the pattern that corresponds to the block scanner output data on the display.

10. The display device of claim 1, further comprising an application processor and a mobile industry processor interface (MIPI), and wherein the display device is included in a timing controller, and the timing controller is structured to receive, in operation of the device, the compressed data from the application processor through the MIPI.

* * * * *